United States Patent [19]

Davignon

[11] 4,449,477

[45] May 22, 1984

[54] LIQUID DISPENSER

[75] Inventor: Paul A. Davignon, Uxbridge, Mass.

[73] Assignee: American Optical Corporation, Southbridge, Mass.

[21] Appl. No.: 349,102

[22] Filed: Feb. 16, 1982

[51] Int. Cl.[3] ..... B05C 3/09

[52] U.S. Cl. ..... 118/694; 118/401; 137/453; 137/454

[58] Field of Search ..... 137/251, 253, 453, 454; 141/1, 2, 18, 21, 29, 82, 110, 111, 112, 113, 192, 198, 230, DIG. 2; 184/103 R, 105 R; 220/231, 254; 222/56; 118/401, 694

[56] References Cited

U.S. PATENT DOCUMENTS

| | | | |
|---|---|---|---|
| 1,838,285 | 12/1931 | Rieke | 220/254 |
| 2,564,230 | 8/1951 | Pitney | 184/103 R X |
| 2,588,214 | 3/1952 | Dawson | 137/253 X |
| 2,615,442 | 10/1952 | Berry | 184/103 R X |
| 3,712,420 | 1/1973 | Pelizzoni et al. | 184/103 R |

*Primary Examiner*—Stephen Marcus
*Assistant Examiner*—Mark Thronson
*Attorney, Agent, or Firm*—Kenway & Jenney

[57] ABSTRACT

Apparatus for dispensing a liquid utilizing surface tension of the liquid for control of amount dispensed.

8 Claims, 5 Drawing Figures

LIQUID DISPENSER

BACKGROUND OF THE INVENTION

1. Field of the Invention

This invention relates to liquid dispensers with particular reference to improvements in level control means for high viscosity liquid dispensers.

2. Discussion of the Prior Art

In situations requiring the dispensing of a constant level of liquid, e.g. for use in dipping articles each requiring application of a controlled amount of an adhesive, lubricant, ink or other such material, the heretofore need for float operated mechanical and/or other electromechanical level sensing and maintaining devices lends complexity and costliness to the operation, not to mention its potential for malfunction particularly in dealings with liquids of high viscosity.

In view of the above, a principal object of this invention is to provide greater efficiency, reliability and economy in liquid dispensing operations. More specifically, there is the objective of providing improvement in liquid dispensing apparatus particularly, but not exclusively, designed to accommodate high viscosity compositions. The term "high viscosity" is herein intended to refer to a fluid that is highly resistant to internal flow.

Other objects and advantages of the invention will become apparent from the following description.

SUMMARY OF THE INVENTION

The foregoing and corollary objectives of the invention are accomplished with a device having no moving parts. The device comprises a dispensing tray, a closed atmosphere reservoir and level control nozzle. A tray filling passage extends into the reservoir beneath the level of liquid to be maintained in the tray.

The level control nozzle provides an air inlet to the reservoir for release of liquid into the dispensing tray as needed for liquid level adjustment. The air inlet is placed at a desired level in the dispensing tray and becomes closed by a liquid reaching same.

When the nozzle air inlet is closed, release of liquid from the reservoir is prevented and the tray level remains constant. Use of liquid from the tray causing lowering of its level to a point exposing the air inlet causes air to enter the reservoir releasing liquid to the tray for replacement of used liquid which again closes the air inlet, and so on.

Minimal fluctuation of liquid level is accomplished with the nozzle functioning in response to movement of a liquid meniscus over and away from its air inlet as the liquid level rises and lowers in the dispensing tray. The meniscus is formed by intermolecular forces of liquid surface tension.

Details of the invention will become more readily apparent from the following description when taken in conjunction with the accompanying drawings in which.

DESCRIPTION OF THE PREFERRED EMBODIMENTS

Figure 1:
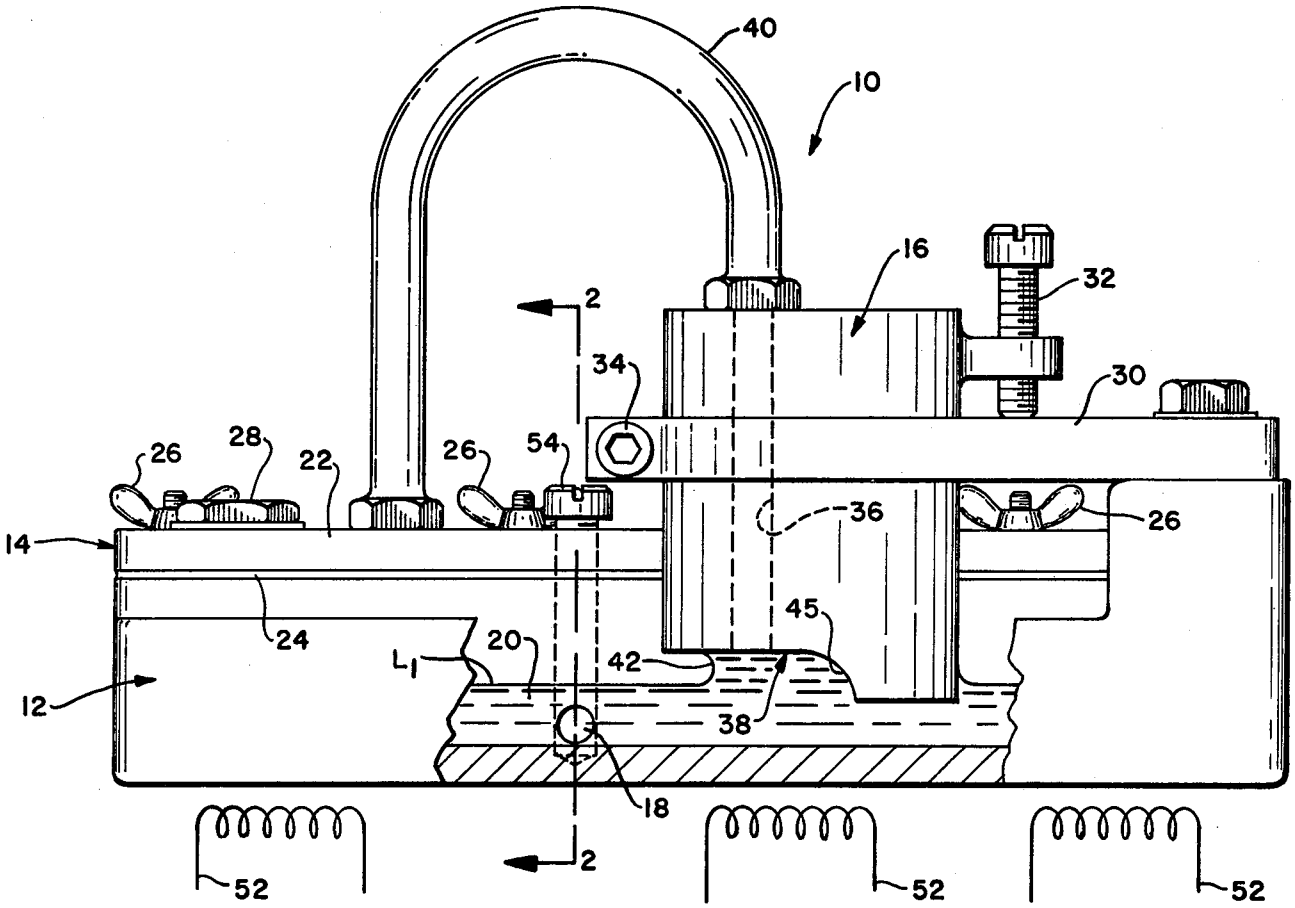
FIG. 1 is a partially cross-sectioned side view of a preferred embodiment of the present invention.
Figure 2:
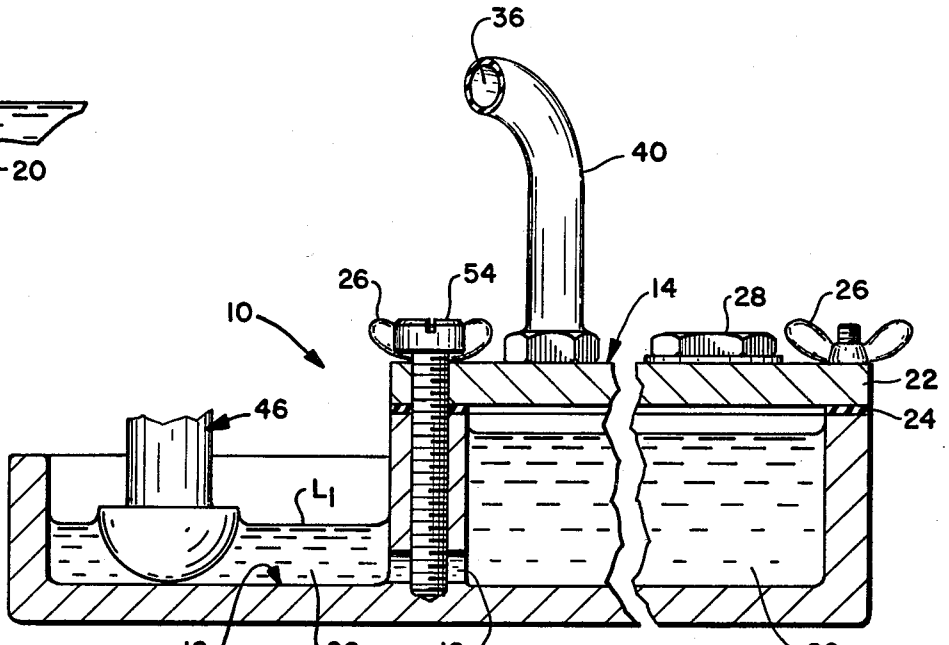
FIG. 2 is a cross-sectional view of the liquid dispenser of FIG. 1 taken approximately along line 2—2.

Referring to the drawings, liquid dispenser 10 comprises a dispensing tray 12, closed reservoir 14 and level control nozzle 16.

A tray filling opening 18 provides communication with reservoir 14 beneath the level of liquid 20 to be maintained in tray 12.

Removable cover 22 having gasket 24 permits filling of the reservoir 14 when needed. Wing nut fasteners 26 facilitate removal and replacement of cover 22. Alternatively, reservoir 14 may be filled by removal of gasketed plug 28, i.e. without removal or loosening of cover 22.

Liquid level control nozzle 16 is supported by bracket 30 and rendered vertically adjustable in the bracket by means of screw 32 following loosening of clamp screw 34. Once adjusted for a desired height in tray 12, clamp screw 34 is tightened.

Nozzle 16 is provided with an air passage 36 extending vertically from its liquid level sensing end 38 into tube 40 which, in turn, communicates with the interior of reservoir 14.

While shown in somewhat exaggerated fashion for clarity of illustration, liquid 20 forms meniscus 42 upon contact with end 38 of nozzle 16 wherewith air passage 36 is closed (FIG. 1). Meniscus 42 results from intermolecular forces of surface tension and is particularly pronounced in high viscosity liquids such as wax, pitch, glue, heavy oils, etc.

Figure 3:
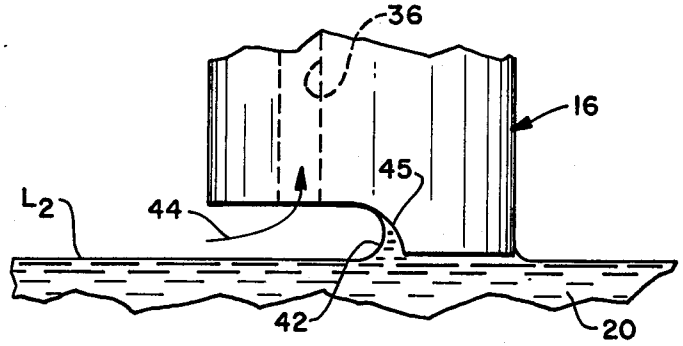
FIG. 3 is a fragmentary elevational view of a nozzle component of the device illustrating a function thereof.

With complete closure of the chamber of reservoir 14 to the external atmosphere by liquid 20 adjacent meniscus 42 (FIG. 1), a flow of liquid from the reservoir supply through opening 18 is stopped and liquid level $L_1$ (FIG. 1) is maintained. However, upon use of liquid 20 in tray 12, e.g. by dipping articles therein for coating and removing same, lowering of liquid level $L_1$ to $L_2$ (FIG. 3) will cause surface tension meniscus 42 to move away from air passage 36 allowing air (arrow 44) to enter passage 36 and vent reservoir 14. Thereupon liquid 20 from the reservoir supply will flow through opening 18 into tray 12 to the point of again reaching level $L_1$ (FIG. 1) and close air passage 36 stopping further flow of liquid 20 through opening 18.

It should be appreciated from the above that liquid level fluctuations are uniquely held to a minimum, i.e. approximately no greater than a diameter of meniscus 42. It should be further noted that the downwardly curved side 45 of nozzle 16 sensing end 38 provides for continuous contact of liquid meniscus 42 with the nozzle and movement of the meniscus takes place in a generally transverse direction across air passage 36 for opening and closing of the air passage with liquid level lowering and rising, i.e. meniscus 42 normally does not break away from sensing end 36 of nozzle 16 whereby exceptional precision of liquid 20 level control is afforded.

Dispenser 10, operating as above without moving parts, obviates the heretofore problems of mechanical and/or electro-mechanical float control systems and further overcomes the failure of gravity operated dispensers to maintain accurate liquid dispensing levels.

With dispenser 10, it becomes possible to apply, with precision, predetermined amounts of a liquid medium to articles dipped into tray 12.

For example, article 46 may comprise a lens block to which a wax, pitch or other blocking medium is to be applied in a carefully controlled amount for receiving a lens to be held thereon for surface finishing.

Figure 5:
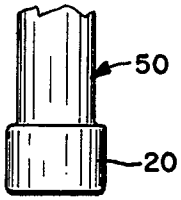
FIGS. 4 and 5 are illustrations of exemplary articles following dip coating according to principles of the invention.
Figure 4:
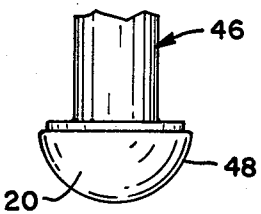

By inserting article 46 fully into tray 12 as illustrated, liquid 20 reaches a given level on the article, i.e. with a known rise of level $L_1$ by displacement. During this time, air passage 36 remains closed. However, with lifting of article 46 out of tray 12 and carrying with it a coating 48 of liquid 20 (FIG. 4) level $L_1$ drops, e.g. to $L_2$ (FIG. 3) initiating replacement in the manner already described. Similarly, rod-like articles 50 (FIG. 5) or other pieces requiring dip coating may be provided with precise amounts of coating material 20 by insertion to the bottom of tray 12 and removal therefrom, the operation being repeatable with an assurance of duplication of coating results.

While the present dispenser 10 provides special utility in the handling of liquids of high viscosity, such as wax, pitch, heavy oil and the like, it should be understood that it is similarly adaptable to the dispensing of lower viscosity liquids. Furthermore, for warmed or hot liquid dispensing, e.g. for wax, dispenser 10 may be placed upon an electrical hot plate or otherwise heated with electrical coils 52 (FIG. 1). Gas burners or other forms of heating devices may be used and/or incorporated as built-in components of the dispenser.

In a hot liquid dispensing operation, it may be preferable to close opening 18 during initial heating of liquid therein. To this end, shutoff 54 may be provided for manual closing and opening of tray filling opening 18. When shutoff 54 is closed during heating of a liquid in reservoir 14, tube 40 functions as a pressure relief passage.

It is intended that various modifications and adaptations of the precise form of the invention described above may be made to suit particular requirements. For example, reservoir 14 and tray 12 may comprise separate units interconnected with a flexible hose in addition to hose 40 for providing the opening 18 between reservoir and tray while flexible hose 40 provides air passage 36. Accordingly, all modifications which incorporate the disclosed novel concept are to be construed as coming within the scope of the following claims or the range of equivalency to which they are entitled.

I claim:

1. A liquid dispenser comprising:

an open dispensing tray;

a closed reservoir, there being a tray filling opening extending from said reservoir to said tray at a point beneath a level of a liquid to be provided to and maintained in said tray;

and an adjustable liquid level control nozzle having a level sensing surface positioned in said tray to maintain a desired tray liquid level and an air passage extending from said sensing surface into said closed reservoir;

wherein a portion of said level sensing surface of said nozzle extends approximately parallel to the liquid level to be maintained in said tray and said air passage extends away from said portion of said nozzle sensing surface;

whereby, when the tray liquid level drops below the level to be maintained, a liquid meniscus traverses past said air passage, thereby venting said air passage and allowing air to enter said closed reservoir, releasing a liquid which is provided to said closed reservoir to flow through said tray filling opening into said open tray;

whereby, when the tray liquid level rises to the level to be maintained, the liquid meniscus traverses past said air passage in a reverse direction, thereby closing said air passage and preventing further liquid flow from said closed reservoir through said tray filling opening.

2. A liquid dispenser according to claim 1 including means for selectively adjusting said nozzle toward and away from a bottom of said tray and for locking said nozzle at a desired position of such adjustment.

3. A liquid dispenser according to claim 2 wherein said air passage from said sensing surface to said closed reservoir is formed at least in part by flexible tubular means providing freedom of said adjustment of said nozzle toward and away from said tray bottom.

4. A liquid dispenser according to claim 1 wherein said level sensing surface of said nozzle includes a continuation of said portion extending approximately parallel to the liquid level to be maintained in said tray, said continuation depending arcuately toward a bottom of said tray.

5. A liquid dispenser according to claim 1 wherein said reservoir includes a gasketed cover for air-tight closure thereof, said cover being removable for liquid filling of said reservoir.

6. A liquid dispenser according to claim 5 including a removable and replaceable air-tight plug in said cover as alternative means of access to said reservoir for said liquid filling.

7. A liquid dispenser according to claim 1 including shutoff means for selectively venting said reservoir independently of said air passage.

8. A liquid dispenser according to claim 1 wherein said tray and reservoir comprise a single unit.

* * * * *